US006837489B2

(12) United States Patent
Kim

(10) Patent No.: US 6,837,489 B2
(45) Date of Patent: Jan. 4, 2005

(54) JAM REMOVING APPARATUS OF MACHINE HAVING ADF FUNCTION

(75) Inventor: Won-taek Kim, Suwon (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 177 days.

(21) Appl. No.: 10/299,762

(22) Filed: Nov. 20, 2002

(65) Prior Publication Data

US 2003/0122296 A1 Jul. 3, 2003

(30) Foreign Application Priority Data

Jan. 2, 2002 (KR) ..... 2002-106

(51) Int. Cl.[7] ..... B65H 5/22; B65H 83/00; B65H 85/00

(52) U.S. Cl. ..... 271/3.14; 271/10.13

(58) Field of Search ..... 271/3.14, 10.13

(56) References Cited

U.S. PATENT DOCUMENTS 4,919,411 A * 4/1990 Ceelen ..... 271/35
5,755,435 A * 5/1998 Fujiwara ..... 271/4.04
6,183,151 B1 * 2/2001 Kono ..... 400/582

* cited by examiner

*Primary Examiner*—Donald P. Walsh
*Assistant Examiner*—Kenneth W. Bower
(74) *Attorney, Agent, or Firm*—Staas & Halsey LLP

(57) ABSTRACT

A jam removing apparatus of a machine having an ADF function to effectively remove a sheet of paper jammed between an ADF roller and a feed roller includes a middle gear engaged with a gear train engaged with an ADF gear of the ADF roller and having a unit to transfer only one-way rotation, a feeding gear engaged with the middle gear and coaxially connected with the feed roller to transfer the paper, and a jam removing unit connected with a shaft of the feeding gear to rotate the feeding gear when removing the jammed paper. The jammed paper is transferred only in a paper supplying direction but not in an opposite direction of the paper supplying direction, thus the jammed paper can be prevented from being damaged by being crumpled by the ADF roller.

27 Claims, 4 Drawing Sheets

JAM REMOVING APPARATUS OF MACHINE HAVING ADF FUNCTION

CROSS-REFERENCE TO RELATED APPLICATIONS

This application claims the benefit of Korean Application No. 2002-106, filed Jan. 2, 2002, in the Korean Intellectual Property Office, the disclosure of which is incorporated herein by reference.

BACKGROUND OF THE INVENTION

1. Field of the Invention

The present invention relates to a machine having an ADF function, such as a facsimile or a combination machine with a photocopying function, and more particularly, to a jam removing apparatus having an ADF function and removing jammed paper in a combination machine.

2. Description of the Related Art

An automatic document feeder (ADF) has a function of feeding sheets of paper to a predetermined position one by one.

Referring to FIG. 1, a conventional machine having the ADF function includes a pick-up roller 10, an ADF roller 20, a feed roller 30, a scan module 40, and a distribution roller 50.

The pick-up roller 10 feeds the sheets of paper 1 contained in a feeding cassette to the ADF roller 20, and the ADF roller 20 separates the paper 1 one by one fed from the pick-up roller 10 and transmits the separated paper 1 to the feed roller 30. The feed roller 30 passes the fed paper 1 to the scan module 40. The scan module 40 reads data from the paper 1 passing through upwardly and stores the data. The paper 1 passing through the scan module 40 is distributed to an outside of the machine by the distribution roller 50.

After that, the data stored in the scan module 40 is either transmitted to another facsimile according to a usage of the machine having the ADF function, or the data is printed on other paper.

However, when the machine having the ADF function is used, sometimes a paper jam can occur, and the paper 1 is stuck between the ADF roller 20 and the feed roller 30.

The jammed paper should be removed when the paper jam occurs. Thus, the conventional machine having the ADF function has a jam removing apparatus to remove the jammed paper. FIG. 2 is a view showing a power transmission in the machine having a conventional jam removing apparatus with the ADF function.

Referring to FIG. 2, a power transmission device with the ADF function includes a motor 70, a driving gear 71, a first gear train 60, an ADF gear 21, a pick-up gear 11, a feeding gear 31, a jam removing apparatus 90, a second gear train 80, and a distribution gear 51.

The driving gear 71 is engaged with the motor 70, the first gear train 60 and the second gear train 80.

The first gear train 60 includes three double gears 61, 62, and 63. The double gears 61 and 63 disposed at both ends of the first gear train 60 are respectively engaged with the ADF gear 21 and the feeding gear 31, and the double gear 62 disposed at a center of the first gear train 60 is engaged with the driving gear 71.

The ADF gear 21 and the pick-up gear 11 are engaged with each other through an idle gear 25.

Moreover, the second gear train 80 includes two double gears 81 and 83 and one idle gear 82. The double gears 81 and 83 disposed at both sides of the second gear train 80 are respectively engaged with the distribution gear 51 and the driving gear 71.

The jam removing apparatus 90 is disposed at a lower side of the feeding gear 31, and includes a jam removing handle 91 which an user can rotate, a first pulley 92 coaxially connected with the jam removing handle 91, a second pulley coaxially connected with the feeding gear 31, and a belt 93 connecting the first pulley 92 and the second pulley.

The machine having the ADF function with the conventional jam removing apparatus 90 transfers a rotation power in a way that will be described hereinbelow.

The motor 70 generates the rotation power to transfer the paper 1 contained in the feeding cassette. Then, the driving gear 71 transfers the rotation power of the motor 70 to the first gear train 60 and the second gear train 80.

After that, the first gear train 60 transfers the rotation power transferred from the driving gear 71 to the ADF gear 21 and the feeding gear 31 to rotate the coaxially connected ADF roller 20 and the feed roller 30. Since the ADF gear 21 is connected with the pick-up gear 11 through the idle gear 25, when the ADF gear 21 rotates, the pick-up gear 11 rotates. Generally, the ADF roller 20 coaxially connected with the ADF gear 21 has a one-way clutch 22, thus even though the ADF gear 21 rotates both directions, the ADF roller 20 rotates only in a paper feeding direction of supplying the paper 1 to the feed roller 30 and does not rotates in an opposite direction opposite to the paper feeding direction.

The feeding gear 31 rotates by the rotation power transferred by the first gear train 60, and the coaxially connected feed roller 30 supplies the paper 1 transferred from the ADF roller 20 to the distribution roller 50.

In addition, the second gear train 80 transfers the rotation power of the driving gear 71 to the distribution gear 51. When the distribution gear 51 rotates, the coaxially connected distribution roller 50 rotates, and the paper 1 transferred from the feed roller 30 is distributed.

Hereinbelow, a process of removing the paper 1 jammed between the ADF roller 20 and the feed roller 30 will be described.

When the paper 1 is jammed, the user rotates the jam removing handle 91. When the jam removing handle 91 rotates, the first pulley 92 coaxially connected with the jam removing handle 91 rotates, and the second pulley also rotates through the belt 93.

When the second pulley rotates, the coaxially connected feeding gear 31 and the feed roller 30 rotate. The jammed paper 1 is transferred to the distribution roller 50 by the rotation of the feed roller 30.

Furthermore, when the feeding gear 31 rotates, the first gear train 60 connected with the feeding gear 31 rotates and transfers a rotation of the jam removing handle 91 to the ADF gear 21. When the ADF gear 21 rotates, the coaxially connected ADF roller 20 also rotates, thus the jammed paper is transferred to the feed roller 30.

Similarly, as the rotation of the jam removing handle 91 rotates the second gear train 80 through the feeding gear 31 and the first gear train 60, the paper 1 passed through the feed roller 30 is distributed through the distribution roller 50 as the distribution roller 50 rotates.

Therefore, the paper 1 jammed between the ADF roller 20 and the feed roller 30 is easily removed when the user rotates the jam removing handle 91.

However, in the conventional jam removing apparatus described so far, when the user rotates the jam removing handle 91 in the opposite direction opposite to the paper feeding direction, the jammed paper is transferred to the ADF roller 20. Yet, the ADF roller 20 rotates in only one direction, thus the paper 1 transferred from the feed roller 30 to the ADF roller 20 cannot be distributed to the pick-up roller 10 and is crumpled therebetween. In other words, when the user rotates the jam removing handle 91 in a wrong manner, the paper 1 is damaged by being crumpled in the ADF roller 20.

Moreover, the rotation of the jam removing handle 91 is transferred by a belt driving apparatus, thus a vast installation space is required, and many elements are also required.

SUMMARY OF THE INVENTION

The present invention has been made to overcome the above and other problems of the prior art. Accordingly, it is the object of the present invention to provide a jam removing apparatus of a machine having an ADF function capable of preventing a sheet of paper from being crumpled by preventing a feeding roller from rotating in an opposite direction to that of a paper proceeding direction.

Another object is to provide a jam removing apparatus of a machine having an ADF function requiring a small space for installation and having less number of necessary parts by transferring a rotation of a jam removing handle by gears.

Additional objects and advantageous of the invention will be set forth in part in the description which follows and, in part, will be obvious from the description, or may be learned by practice of the invention.

In order to achieve the above and other objects, a jam removing apparatus of a machine having an ADF function according to an embodiment of the present invention to remove a sheet of paper jammed between an ADF roller and a feed roller, includes a middle gear engaged with a gear train engaged with an ADF gear of the ADF roller and having a unit to transfer only one-way rotation, a feeding gear engaged with the middle gear and coaxially connected with the feed roller to transfer the paper, and a jam removing unit connected with a shaft of the feeding gear to rotate the feeding gear so as to remove the jammed paper from a paper feeding path.

It is possible that the unit to transfer only one-way rotation is a one-way clutch.

In addition, the jam removing unit includes a jam gear engaged with the feeding gear and a handle coaxially connected with the jam gear to rotate the jam gear so as to remove the jammed paper from the paper feeding path.

It is possible that the jam removing unit has an intermediate gear disposed between the feeding gear and the jam gear.

BRIEF DESCRIPTION OF THE DRAWINGS

These and other objects and advantages of the invention will become apparent and more readily appreciated from the following description of the preferred embodiments, taken in conjunction with the accompanying drawings of which.

DETAILED DESCRIPTION OF THE PREFERRED EMBODIMENTS

Figure 1:
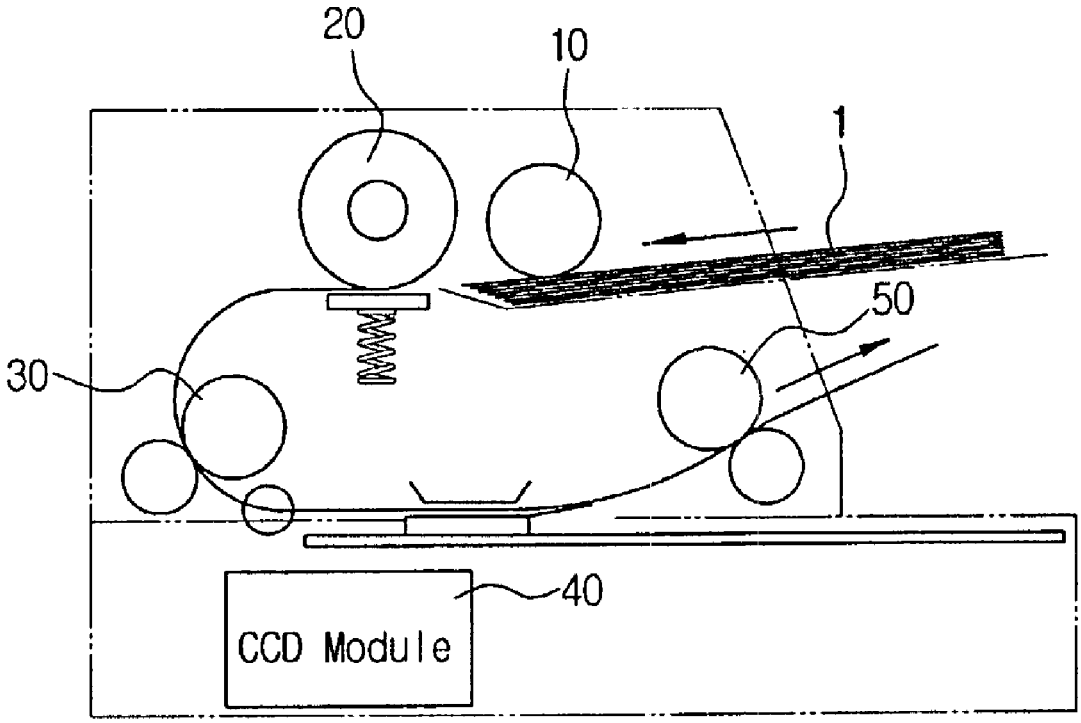
FIG. 1 (PRIOR ART)
FIG. 1 is a diagram schematically showing a structure of a machine having an ADF function.

Reference will now be made in detail to the present preferred embodiments of the present invention, examples of which are illustrated in the accompanying drawings, wherein like reference numerals refer to the like elements throughout. The embodiments are described in order to explain the present invention by referring to the figures.

Figure 2:
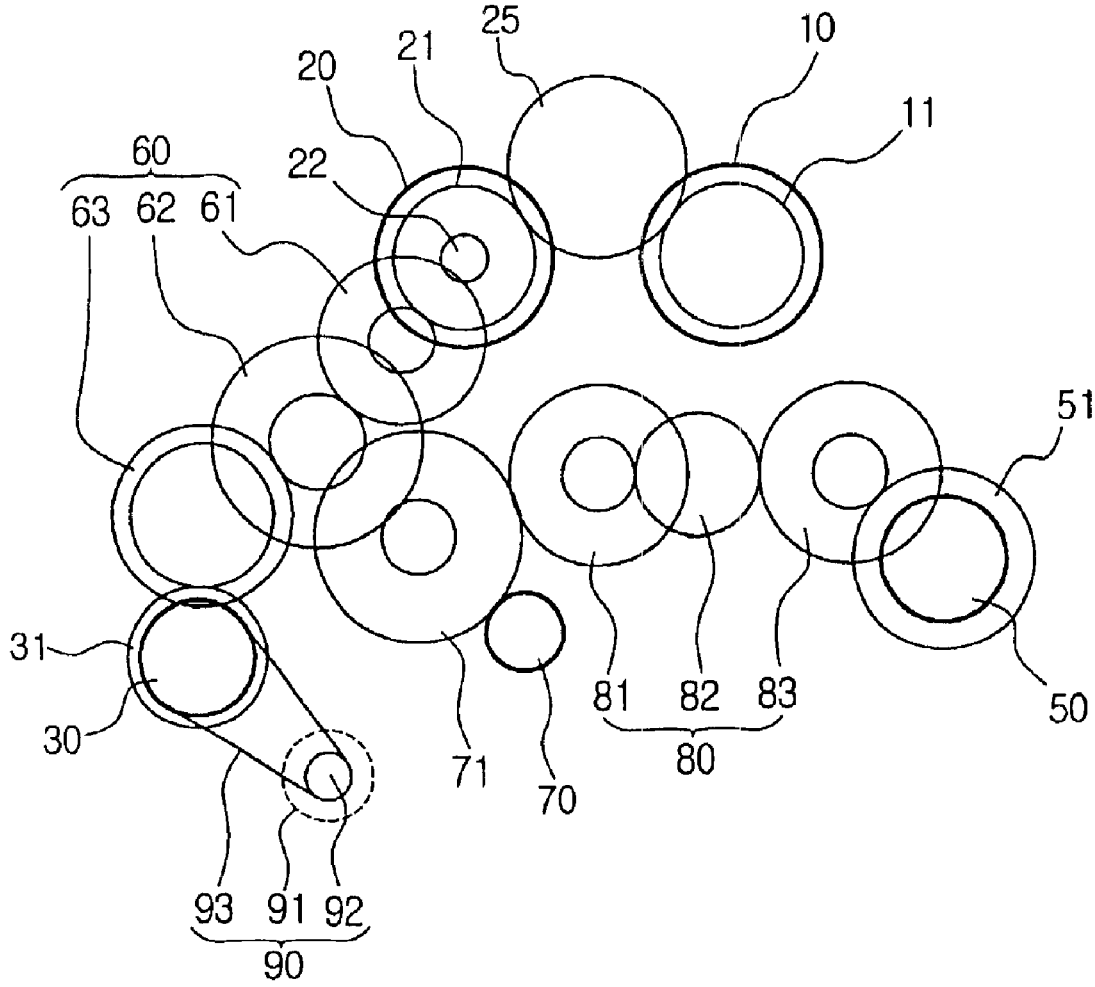
FIG.2 (PRIOR ART)
FIG. 2 is a view showing the power transmission of the machine having the ADF function including a conventional jam removing apparatus of FIG. 1.

Herein below, embodiments of a jam removing apparatus of a machine having an automatic document feeding (ADF) function according to the present invention will be described in greater detail by referring to the appended drawings. Here, the same elements with a conventional machine of FIGS. 1 and 2 will be given the same reference numerals and described.

Figure 3:
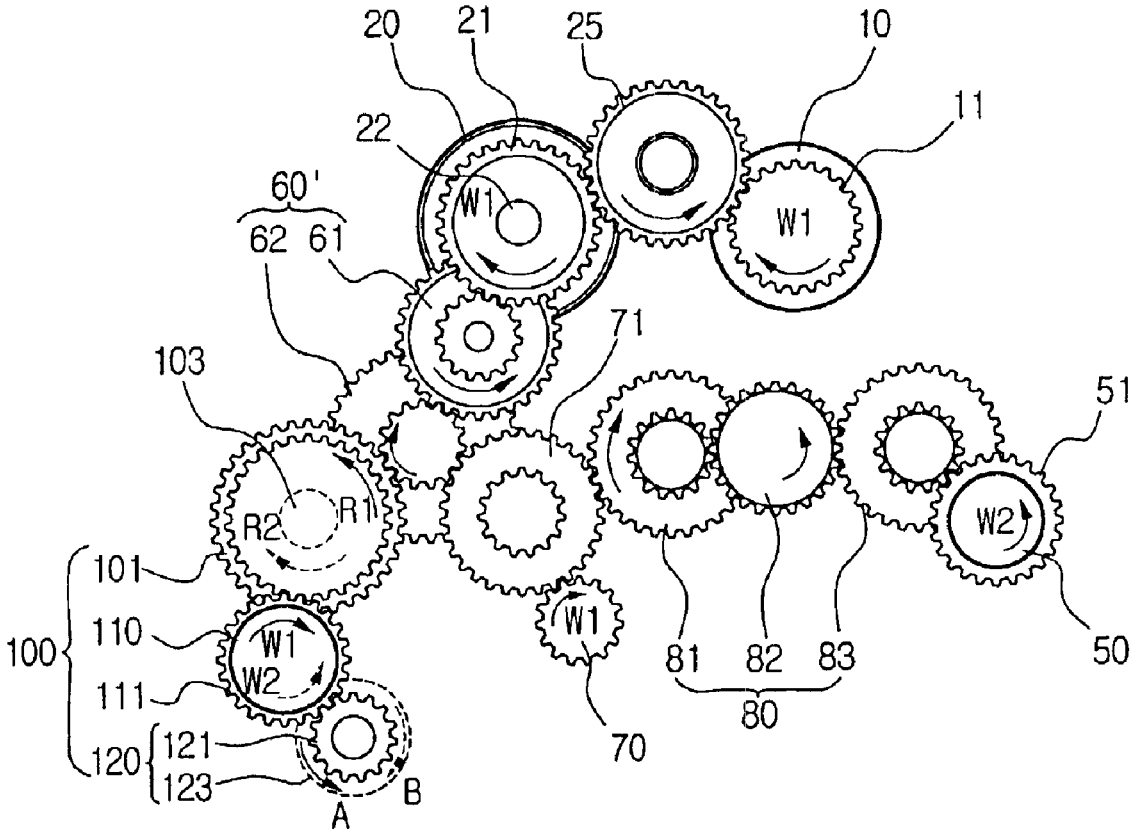
FIG. 3 is a view showing a power transmission of a machine having an ADF function including a jam removing apparatus according to an embodiment of the present invention.

FIG. 3 is a view showing a power transmission in the machine having the ADF function including the jam removing apparatus according to an embodiment of the present invention.

Referring to FIG. 3, the machine having the ADF function includes a motor 70, a driving gear 71, a first gear train 60', an ADF gear 21, a pick-up gear 11, a jam removing apparatus 100, a second gear train 80, and a distribution gear 51.

The driving gear 71 is engaged with the motor 70, the first gear train 60' and the second gear train 80.

The first gear train 60' includes two double gears 61 and 62. One double gear 61 is engaged with the ADF gear 21, and the other double gear 62 is engaged with a middle gear 101 and the driving gear 71.

The ADF gear 21 and the pick-up gear 11 are engaged with each other through a first idle gear 25.

In addition, the second gear train 80 includes two double gears 81 and 83 and one second idle gear 82. The double gears 83 and 81 disposed at both sides of the second gear train 80 are respectively engaged with the distribution gear 51 and the driving gear 71.

The jam removing apparatus 100 includes a middle gear 101, a feeding gear 111, and a jam removing unit 120.

The middle gear 101 is a double gear and engaged with the first gear train 60' and the feeding gear 111. Furthermore, the middle gear 101 includes a unit to rotate the middle gear 101 in only one direction. The means to rotate one direction is disposed between the middle gear 101 and an axle of the middle gear 101 to allow the middle gear 101 to rotate in only one direction.

The feeding gear 111 is coaxially connected with a feed roller 110 and is connected with the jam removing unit 120. A pickup roller 10, an ADF roller, the feed roller 110, and a discharge roller 50 are disposed along a paper feeding path of a sheet of paper and on one of an inside portion and an outside portion of the paper feeding path.

The jam removing unit 120 includes a jam gear 121 engaged with the feeding gear 111 and a jam removing handle 123 rotating the jam gear 121. The jam removing handle 123 is coaxially connected with the jam gear 121.

Hereinbelow, an operation of the machine having the ADF function including the jam removing apparatus 100 according to this embodiment of the present invention is described.

The motor 70 generates a rotation power to transfer the paper accumulated in a feeding cassette. Then, the driving gear 71 transfers the rotation power of the motor 70 to the first gear train 60' and the second gear train 80.

The first gear train 60' rotates the ADF roller 20 and the middle gear 101 by transferring the rotation power transferred from the driving gear 71 to the ADF gear 21 and the middle gear 101. The ADF gear 21 is connected with the pick-up gear 11 through the first idle gear 25, thus when the ADF gear 21 rotates, the pick-up gear 11 rotates. Here, the ADF roller 20 coaxially connected with the ADF gear 21 has a one-way clutch 22, thus even though the ADF gear 21 rotates in both directions, the ADF roller 20 rotates only in a clockwise direction W1, which is a paper supplying (distribution) direction, not a counterclockwise direction.

The middle gear 101 transfers the power of the first gear train 60' to the feeding gear 111. When the feeding gear 111 rotates, the feed roller 110 coaxially connected with the feeding gear 111 rotates and transfers the paper to the distribution roller 50. However, since a one-way clutch 103 is installed at the middle gear 101. When the middle gear 101 rotates anti-clockwise] in the counterclockwise direction R1, the feed roller 110 rotates in the clockwise direction W1, that is the paper supplying direction, not the clockwise direction. If the feed roller 110 is disposed on the same outside portion of the power feeding path as the ADF roller 20, the ADF roller 20 and the feed roller 110 rotate in the same counterclockwise direction to feed the paper in the paper supplying direction. To the contrary, if the feeding roller 110 is disposed on the inside position of the paper feeding path while the ADF roller 20 is disposed on the outside portion of the paper feeding path, the ADF roller 20 and the feed roller 110 rotate in the counterclockwise direction and in the clockwise direction, respectively, to feed the paper in the paper supplying direction.

Furthermore, the second gear train 80 transfers the rotation power of the driving gear 71 to the distribution gear 51. When the distribution gear 51 rotates, the coaxially connected distribution roller 50 rotates and the paper transferred from the feed roller 110 is distributed.

In other words, when the motor 70 rotates in the clockwise direction W1, then the pick-up roller 10, the ADF roller 20 and the feed roller 110 rotate in the clockwise direction W1, and the distribution roller 50 rotates in the counterclockwise direction W2 so as to transfer and distribute the paper supplied by the pick-up roller 10 along the paper feeding path. At this time, the middle gear 101 rotates in the counterclockwise direction R1, thus the rotation power is transferred to the feed roller 110.

Hereinbelow, an operation of removing the paper jammed between the ADF roller 20 and the feed roller 110 will be described.

When the user rotates the jam removing handle 123 in the counterclockwise A, the jam gear 121 coaxially connected with the jam removing handle 123 rotates in the counterclockwise direction A. When the jam gear 121 rotates in the counterclockwise direction A, the feeding gear 111 rotates in the clockwise direction W1.

When the feeding gear 111 rotates in the clockwise direction W1, the middle gear 101 rotates in the counterclockwise direction R1, thus the jammed paper is transferred to the distribution roller 50 by the feed roller 110 like a case that the rotation power is transferred by the motor 70.

To the contrary, when the user rotates the jam removing handle 123 in the clockwise direction B, the jam gear 121 coaxially connected with the jam removing handle 123 rotates in the clockwise direction B, and the feeding gear 111 receives power tending to rotate in the counterclockwise direction W2.

However, the feeding gear 111 does not rotate in the counterclockwise direction W2 as the middle gear 101 engaged with the feeding gear 111 does not rotate in the clockwise direction R2. In other words, when the jam removing handle 123 is rotated in the clockwise direction B, the feed roller 110 does not rotate, thus the jammed paper is not transferred to an opposite direction of the paper supplying direction.

Therefore, there is no possibility that the jammed paper is transferred in the opposite direction of the paper supplying direction, and the paper is blocked by the ADF roller 20 and damaged.

Moreover, as the jam gear 121 coaxially connected with the jam removing handle 123 is directly engaged with the feeding gear 111, the jammed paper can be removed without having a pair of a pulley and a belt. Therefore, not much of an installation space is required and the number of the elements of the jam removing apparatus 100 is reduced.

Figure 4:
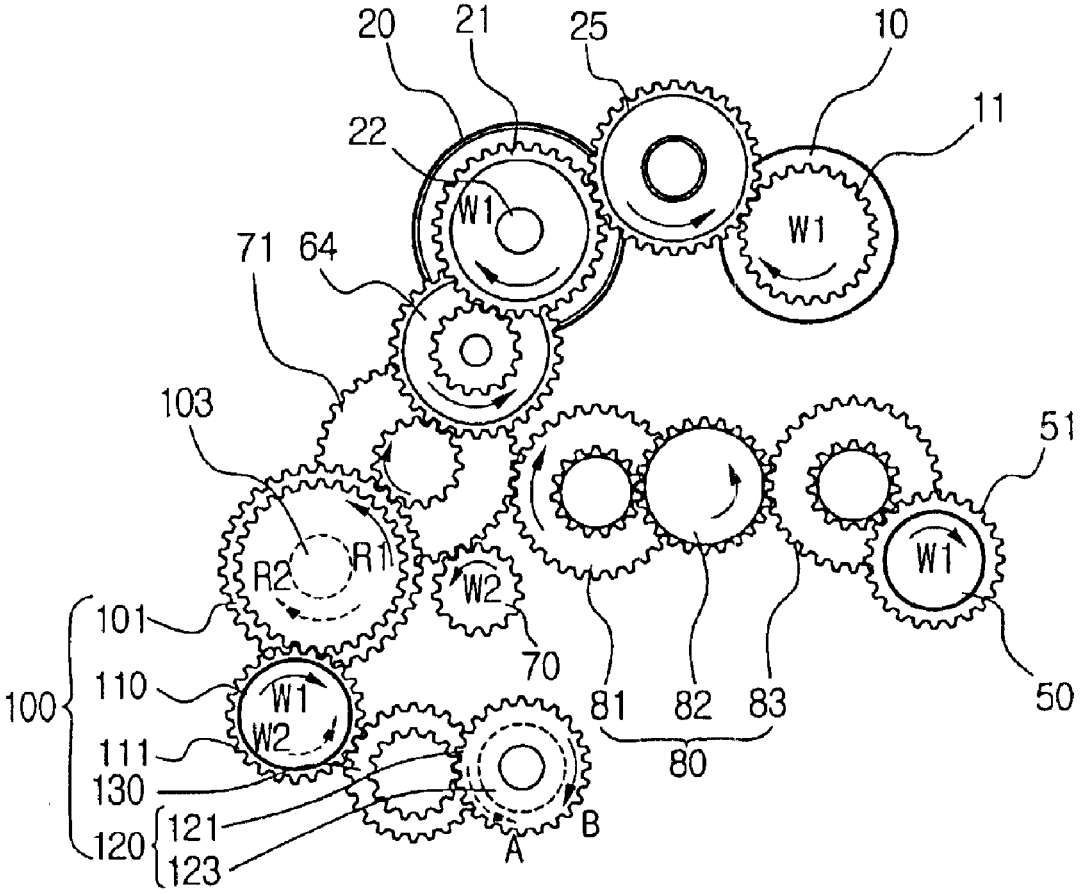
FIG. 4 is a view showing another power transmission of the machine having the ADF function including the jam removing apparatus according to another embodiment of the present invention.

FIG. 4 is a view showing the power transmission of the machine having the ADF function including another jam removing apparatus 100 according to another embodiment the present invention.

Referring to FIG. 4, the machine having the ADF function includes the motor 70, the driving gear 71, the first double gear 64, the ADF gear 21, the pick-up gear 11, the jam removing apparatus 100', and the second gear train 80, and the feeding gear 51.

The jam removing apparatus 100' is identical to the jam removing apparatus 100 of FIG. 3 except that an intermediate gear 130 is disposed between the feeding gear 111 and the jam gear 121.

The intermediate gear 130 is a double gear having one gear engaged with the feeding gear 111 and another gear engaged with the jam gear 121. A force required to rotate the jam removing handle 123 is reduced using the intermediate gear 130.

In addition, other power transferring elements are also the same as those in machine of FIG. 3 except that the first gear train 60' is replaced by one first double gear 64.

Accordingly, the machine having the ADF function including the jam removing apparatus 100' shown in FIG. 4 is identical to that of the machine of FIG. 3 except for a rotation direction of the motor 70 and the distribution roller 50. In other words, when the motor 70 rotates in the counterclockwise direction W2, the pick-up roller 10, the ADF roller 20, the feed roller 110, and the distribution roller 50 all rotate in the clockwise direction W1 to convey and distribute the paper fed by the pick-up roller 10 along the paper feeding path. At this point, the rotation power is transmitted to the feeding roller 110 as the intermediate gear 101 rotates in the counterclockwise direction R1.

An operation of the jam removing apparatus 100' removing the jammed paper is also the same to that of the jam removing apparatus 100 of FIG. 3. However, the rotation direction of the jam removing handle 123 of FIG. 4 for removing the paper jam is opposite to that of the jam removing handle of FIG. 3 as the intermediate gear 130 is disposed in between the feeding gear 111 and the jam gear 121.

That is, when the jam removing handle 123 rotates in the clockwise direction B, the intermediate gear 130 rotates in the counterclockwise direction and the feeding roller 111 rotates in the clockwise direction W1. Accordingly the jammed paper is distributed through the distribution roller 50. To the contrary, when the jam removing handle 123 rotates in the counterclockwise direction A, the jammed paper is not conveyed in the opposite direction of the paper supplying direction as the intermediate gear 130 tending to rotate in the clockwise direction and the feeding roller 111 tending to rotate in the counterclockwise direction R2 do not rotate by the intermediate gear 101.

Therefore, the jammed paper being conveyed in the opposite direction of the paper supplying direction and damaged by being blocked by the ADF roller 20 does not occur.

According to the jam removing apparatus of the machine having the ADF function according to the present invention, the jammed paper is transferred only in the paper supplying direction but not in the opposite direction, thus the jammed paper can be prevented from being damaged by being crumpled.

Additionally, the gear is used instead of a belt power transmission element in the jam removing unit, thus the installation space is reduced and the required elements are reduced also.

Although the preferred embodiment of the present invention has been described, it will be understood by those skilled in the art that the present invention should not be limited to the described preferred embodiment, but various changes and modifications can be made in this embodiment without departing from the principles and sprit of the invention, the scope of which is defined in the claims and their equivalents.

What is claimed is:

1. A jam removing apparatus of a machine having an ADF function and removing a sheet of paper jammed between an ADF roller and a feed roller disposed on a paper feeding path, comprising:

a gear train engaged with an ADF gear of the ADF roller to rotate the ADF roller;

a middle gear engaged with the gear train and having a one-way unit to transfer only one-way rotation;

a feeding gear engaged with the middle gear and coaxially connected with the feed roller to transfer the paper along the paper feeding path in response to the one-way rotation of the one-way unit of the middle gear; and a jam removing unit connected with a shaft of the feeding gear to rotate the feeding gear so as to remove the jammed paper from the paper feeding path.

2. The jam removing apparatus of claim 1, wherein the one-way unit is a one-way clutch.

3. The jam removing apparatus of claim 1, wherein the jam removing unit comprises:

a jam gear engaged with the feeding gear; and a handle coaxially connected with the jam gear to rotate the jam gear to remove the jammed paper.

4. The jam removing apparatus of claim 1, wherein the jam removing unit comprises:

an intermediate gear engaged with the feeding gear;

a jam gear engaged with the intermediate gear; and a handle coaxially connected with the jam gear and rotating the jam gear to remove the jammed paper.

5. The jam removing apparatus of claim 4, wherein the intermediate gear is a double gear.

6. A jam removing apparatus of a machine having an ADF function, removing a jammed paper from a paper feeding path, and including an ADF roller and a feed roller both disposed on the paper feeding path to feed a picked-up paper in a paper supplying direction, comprising:

a motor;

a gear train connected between the motor and an ADF gear of the ADF roller to rotate the ADF roller;

a feeding gear formed on feed roller;

a middle gear connected between the feeding gear and the gear train and having a one-way rotation unit to rotate the feed roller in a one-way direction to feed the picked-up paper; and a jam removing unit connected to the feeding gear to rotate the feed roller in the one-way direction to remove the jammed paper from the paper feeding path.

7. The jam removing apparatus of claim 6, wherein the gear train comprises:

a first gear connected between the motor and the ADF gear; and a second gear connected between the motor and the middle gear.

8. The jam removing apparatus of claim 6, wherein the motor comprises:

a driving gear connected to the motor and transferring a rotation power to the ADF roller and the feed roller through the gear train.

9. The jam removing apparatus of claim 6, wherein the gear train is coupled between the ADF gear and the driving gear, and the middle gear is connected between the driving gear and the feeding gear.

10. The jam removing apparatus of claim 6, wherein the ADF gear comprises:

another one-way rotation unit rotating the ADF roller in a second one-way direction.

11. The jam removing apparatus of claim 10, wherein the second one-way direction of the ADF roller is the same as the one-way direction of the feed roller.

12. The jam removing apparatus of claim 10, wherein the second one-way direction of the ADF roller is different from the one-way direction of the feed roller.

13. The jam removing apparatus of claim 10, wherein the ADF roller and the feed roller feed the pickup paper in the paper supplying direction along the paper feeding path by rotating in the one-way direction and the second one-way direction, respectively.

14. The jam removing apparatus of claim 6, wherein the middle gear comprises an axle, and the one-way rotation unit is connected between the middle gear and the axle of the middle gear to rotate the feed roller coupled to the middle gear in the one-way direction.

15. The jam removing apparatus of claim 6, wherein the machine comprises a pickup roller and a distribution roller, and the ADF roller and the feed roller are disposed between the pickup roller and the distribution roller to receive the picked-up paper and to feed the picked-up paper toward the distribution roller, respectively.

16. The jam removing apparatus of claim 6, wherein the jam removing unit comprises:

a jam gear engaged with the feed gear; and a handle formed on the jam gear to rotate the jam gear so as to rotate the feed roller in the one-way direction.

17. The jam removing apparatus of claim 16, wherein the jam gear comprises a shaft, and the handle is coaxially connected to the shaft of the jam gear.

18. The jam removing apparatus of claim 16, wherein the jam removing unit comprises:

an intermediate gear disposed between the jam gear and the feed gear to reduce a force rotating the handle.

19. The jam removing apparatus of claim 6, wherein the machine comprises a jammed paper disposed on the paper feeding path, and the ADF roller and the feed roller rotate in the one-way direction to transfer the jammed paper only in the paper supplying direction.

20. The jam removing apparatus of claim 19, wherein the jammed paper is not transferred in a direction opposite to the paper supplying direction.

21. A jam removing apparatus of a machine having an ADF function and removing a jammed paper from a paper feeding path, comprising:

a pickup roller picking up a sheet of paper to introduce the pickup paper;

a distribution roller discharging the picked-up paper toward an outside of the machine;

first and second feed rollers disposed between the pickup roller and the distribution roller along the paper feeding path to feed the picked-up paper along the paper feeding path in a paper supplying direction from the pickup roller toward the distribution roller;

a first one-way unit disposed on the first feed roller to rotate the first feed roller in a first one-way direction when the picked-up paper is fed, and when the jammed paper is removed from the paper feeding path;

a second one-way unit rotating the second feed roller in a second one-way direction when the picked-up paper is fed, and when the jammed paper is removed from the paper feeding path; and a jam removing unit connected to one of the feed rollers to rotate the first and second feed rollers in the first and second one-way directions, respectively.

22. The jam removing apparatus of claim 21, wherein first and second feed rollers comprises a first feeding gear and a second feeding gear, respectively, the pickup roller comprises a pickup gear coupled to the first feeding gear, the distribution roller comprises a distribution gear, the machine further comprises:

a motor; and a driving gear connected to the motor to transmit a rotation power to the first feeding gear, the second feeding gear, and the distribution gear.

23. The jam removing apparatus of claim 22, further comprising:

a middle gear connected between the driving gear and the second feeding gear to transmit the rotation power from the driving gear to the second feeding gear, wherein the second one-way unit is disposed on the middle gear.

24. The jam removing apparatus of claim 22, wherein the jam removing unit moves in a third direction or in a fourth direction opposite to the third direction, and the one of the feed rollers connected to the jam removing unit rotates when the jam removing unit rotates in the third direction.

25. The jam removing apparatus of claim 24, wherein the one of the feed rollers does not rotate when the jam removing unit rotates in the fourth direction.

26. The jam removing apparatus of claim 24, wherein the first and second one-way directions are same so as to feed a sheet of paper in the paper feeding path when the first and second feed rollers are disposed on the same side of the paper feeding path.

27. The jam removing apparatus of claim 24, wherein the first and second one-way directions are opposite to each other so as to feed a sheet of paper in the paper feeding path when the first and second feed rollers are disposed to be opposite to each other with respect to the paper feeding path.

* * * * *